United States Patent [19]

Goodell

[11] Patent Number: 4,875,650

[45] Date of Patent: Oct. 24, 1989

[54] CURTAIN SUPPORTING BRACKET

[76] Inventor: Jeffrey W. Goodell, 12375 Mount Jefferson Terrace, Apt. #10-G, Lake Oswego, Oreg. 97035

[21] Appl. No.: 211,854

[22] Filed: Jun. 27, 1988

[51] Int. Cl.[4] ..... A47H 1/10

[52] U.S. Cl. ..... 248/261; 160/127; 211/41

[58] Field of Search ..... 248/261, 262, 254, 251, 248/475.1, 312.1, 208, 255, 263; 160/127, 902; 211/41, 90

[56] References Cited

U.S. PATENT DOCUMENTS

| | | | |
|---|---|---|---|
| 2,293,662 | 8/1942 | Richardson | 248/263 X |
| 2,300,781 | 11/1942 | Gilley | 211/41 |
| 2,350,085 | 5/1944 | Yashan | 160/293.1 |
| 2,386,854 | 10/1945 | Hilton | 248/255 X |
| 2,464,295 | 3/1949 | Edgar | 248/475.1 X |
| 2,918,245 | 12/1959 | Cameron | 248/263 |
| 3,060,490 | 10/1962 | Saito | 248/255 X |
| 4,071,218 | 1/1978 | Pecka et al. | 248/312.1 X |
| 4,120,474 | 10/1978 | Hurley | 248/263 |
| 4,592,471 | 6/1986 | Bross | 211/41 |

*Primary Examiner*—Ramon O. Ramirez
*Attorney, Agent, or Firm*—James D. Givnan, Jr.

[57] ABSTRACT

A bracket for wall attachment having a channel on its underside to receive a drapery supporting track. An uppermost surface of the bracket includes inclined surfaces to facilitate inclined drilling of the bracket and subsequent installation of a fastener for passage into supporting room wall construction. An inclined surface on the bracket provides a visual reference during drilling of the bracket. A recessed area in the bracket uppermost surface receives the lower extremity of a plate or other item to be displayed.

2 Claims, 1 Drawing Sheet

CURTAIN SUPPORTING BRACKET

BACKGROUND OF THE INVENTION

The present invention pertains generally to bracket structures for installation on a wall surface for supporting a curtain traverse rod.

Curtain traverse rods are usually attached to a wall surface adjacent a window opening by means of support arms secured to the wall surface. Recent improvements have included the provision of a wall mounted bracket coterminous with the curtain or curtains. Such a bracket is fastened to the wall at points along the bracket. A problem exists in securing such brackets to a vertical wall surface in that inclined bores must be drilled at locations therealong to assure fastener engagement with the room wall studs. Accordingly, the installation of full length curtain brackets onto a wall constitutes an arduous, time-consuming task even for skilled workmen. The task is complicated by reason of previous brackets having horizontal, fastener receiving surfaces which are not easily bored for fastener reception and often do not provide an attractive appearance with the fasteners in place.

SUMMARY OF THE PRESENT INVENTION

The present invention is embodied within a curtain mounting bracket the length of the curtain being supported and which is provided with an irregular upper surface to facilitate installation of fasteners securing the bracket to a wall surface. Such surfaces may also serve to support articles for display.

The present curtain bracket includes a rear wall for abutment with a room wall surface. Adjacent the rear wall of the bracket is a downwardly inclined bracket surface which lends itself to being drilled and fastener insertion during bracket installation. A companion inclined surface provides a reference to facilitate drilling of the bracket at the correct angle. The upper surface of the bracket additionally defines a recessed area in which may be placed the lower edge of an article being displayed such as dinnerware.

Important objectives include the provision of a curtain bracket having inclined surfaces thereon which greatly facilitate drilling of fastener receiving bores at the required interval to insure proper fastener insertion into wall studs; the provision of a curtain bracket having a reference surface along its top wall to aid the workman during installation of the bracket; the provision of a curtain bracket having a recessed area along its top wall in which may be supported various items to be displayed, as for example, attractive dinner plates.

DETAILED DESCRIPTION OF THE PREFERRED EMBODIMENTS

Figure 1:
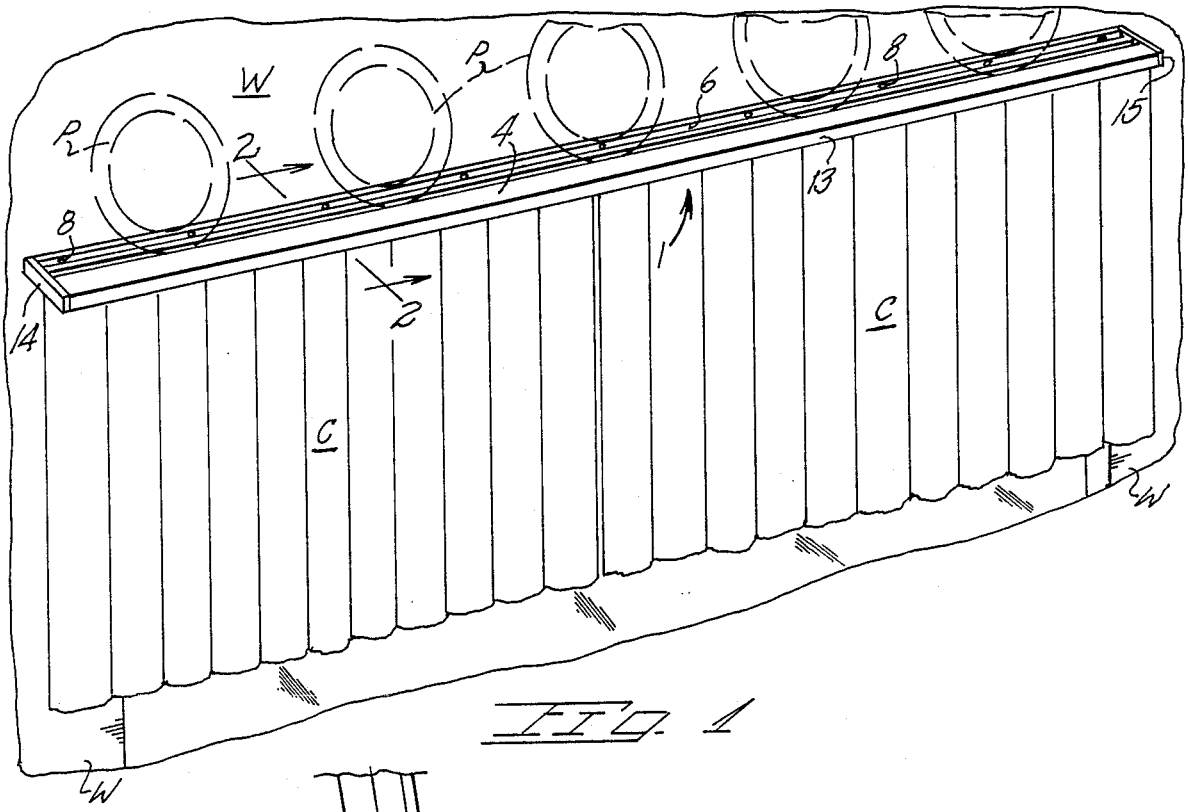
FIG. 1 is a perspective view of an installed curtain bracket with articles supported thereon shown in phantom lines.
Figure 2:
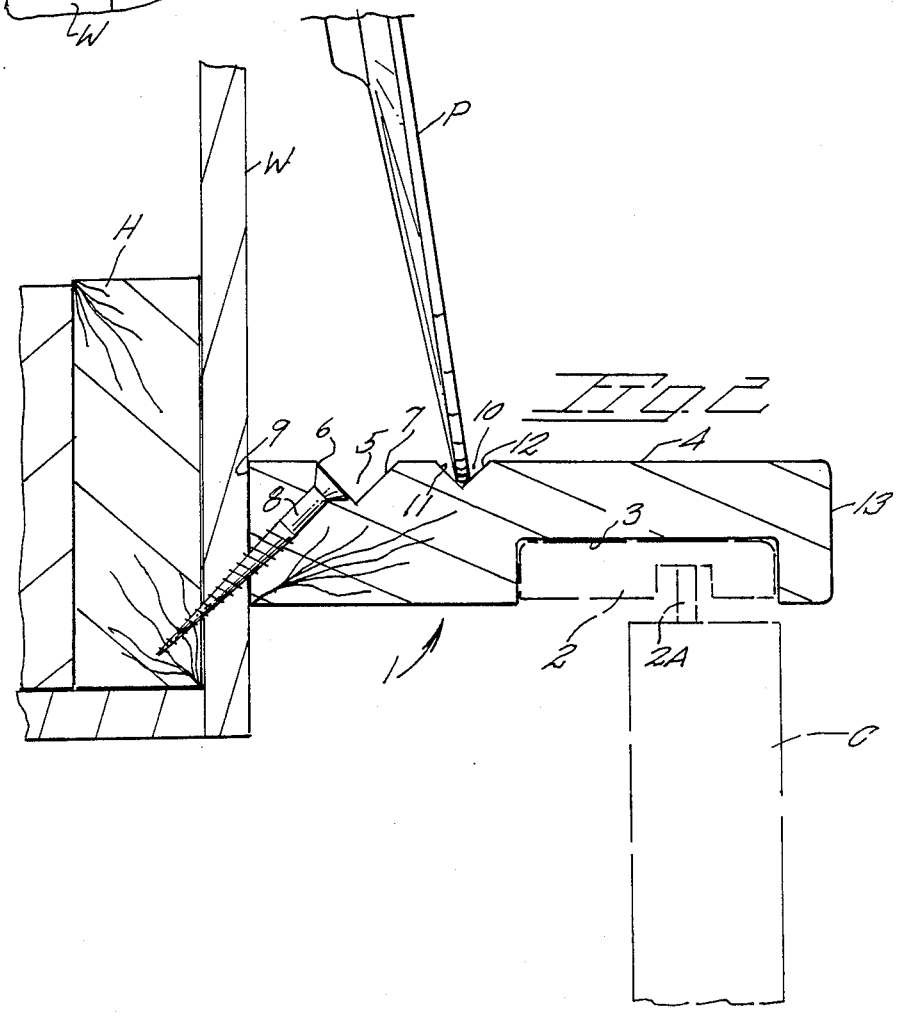
FIG. 2 is a vertical sectional view taken along line 2—2 of FIG. 1.

With continuing attention to the drawings wherein applied reference numerals indicate parts similarly hereinafter identified, the reference numeral 1 indicates generally the present bracket shown in place on a wall at W.

A curtain or drapery at C is suspended from a drapery track 2 suitably secured in an inset manner in a channel 3. Such drapery tracks are of the type manufactured by the Kirsch Company for attachment to horizontal surfaces such as ceilings and termed in the trade ceiling drapery tracks. A slide is at 2A.

The uppermost or top wall 4 of the bracket is irregular in that a recess at 5 is defined by inclined, converging wall surfaces at 6 and 7. Preferably the surfaces 6 and 7 are normal to one another for reasons noted later. Wall surface 6 is inclined to facilitate drilling of same at an angle, 45 degrees or so, to permit optimum installation of a screw or fastener at 8 which passes through a bracket rear wall or edge 9. The wall surface 7 provides a visual reference to facilitate boring of the bracket at the proper angle. A window header is at H.

A second recess at 10 in the bracket is defined by wall surfaces 11 and 12 which recess receives the lower extremity of an article to be displayed such as a decorative plate P or other attractive item. Obviously the recess could be otherwise defined as its function is to confine the lower extremity against outward slippage of same from a room wall W. The plates or other articles displayed may conceal the fasteners which is desirable in multilevel rooms having high ceilings where the top of the bracket is exposed to view from a raised area of the room. An outer face of the bracket is at 13. End members at 14 and 15 on the bracket close the ends of the recesses 5 and 10.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

1. A curtain supporting bracket of horizontally elongate shape for lengthwise wall attachment above a window, said bracket having a rear wall extending horizontally the length of the bracket for surfacial abutment with a room wall, a top wall, an inclined surface coterminous with the top wall and partially defining a recess extending the length of the bracket, said inclined surface adapted to be bored at intervals therealong to receive wall penetrating fasteners for anchoring the bracket to the room wall, said bracket having a bottom wall defining a lengthwise disposed recessed area extending the length of the bracket for the concealed reception of a curtain supporting track.

2. The bracket claimed in claim 1 wherein said top wall defines an additional recess parallel to the first mentioned recess for the reception of the lower extremity of a decorative plate to be displayed.

* * * * *